US006474213B1

(12) United States Patent
Walker et al.

(10) Patent No.: US 6,474,213 B1
(45) Date of Patent: Nov. 5, 2002

(54) REACTIVE STIFFENING ARMOR SYSTEM

(75) Inventors: James D. Walker, San Antonio, TX (US); Dennis L. Orphal, Pleasanton, CA (US)

(73) Assignee: Southwest Research Institute, San Antonio, TX (US)

( * ) Notice: Subject to any disclaimer, the term of this patent is extended or adjusted under 35 U.S.C. 154(b) by 113 days.

(21) Appl. No.: 09/634,197

(22) Filed: Aug. 9, 2000

(51) Int. Cl.[7] ..... F41H 5/04

(52) U.S. Cl. ..... 89/36.17; 89/36.02; 89/36.04; 89/36.08; 89/36.09; 89/36.05; 89/36.07; 89/36.12; 109/11; 109/12; 109/13; 109/26; 109/27; 109/36; 109/37; 109/49.5; 109/80; 109/81; 109/82; 109/84; 109/79

(58) Field of Search ..... 89/36.02, 36.04, 89/36.08, 36.09, 36.05, 36.07, 36.12, 36.17; 109/11, 12, 13, 26, 27, 36, 37, 49.5, 80, 81, 82, 84, 79

(56) References Cited

U.S. PATENT DOCUMENTS

| | | | | | |
|---|---|---|---|---|---|
| 4,368,660 | A | * | 1/1983 | Held | |
| 4,741,244 | A | * | 5/1988 | Ratner | |
| 4,752,970 | A | * | 6/1988 | Arakaki | |
| 4,867,077 | A | | 9/1989 | Marlow et al. | 109/36 |
| 4,869,152 | A | | 9/1989 | Marlow et al. | 89/36.17 |
| 4,901,622 | A | | 2/1990 | Perry | 89/36.02 |
| 4,981,067 | A | | 1/1991 | Kingery | 89/36.17 |
| 5,012,721 | A | | 5/1991 | Medin et al. | 89/36.17 |
| 5,070,764 | A | | 12/1991 | Shevach et al. | 89/36.17 |
| 5,206,451 | A | * | 4/1993 | Bocker | |
| 5,293,806 | A | | 3/1994 | Gonzalez | 89/36.03 |
| 5,303,654 | A | * | 4/1994 | Held | |
| 5,370,034 | A | | 12/1994 | Turner et al. | 89/36.02 |
| 5,577,432 | A | | 11/1996 | Becker et al. | 89/36.17 |
| 5,637,824 | A | | 6/1997 | Benyami | 89/36.17 |
| 5,811,712 | A | * | 9/1998 | Held | |

FOREIGN PATENT DOCUMENTS

| | | | |
|---|---|---|---|
| FR | 2368598 | * | 5/1978 |
| FR | 2632059 | * | 12/1989 |
| GB | 2192697 A | * | 4/1986 |
| GB | 2231129 A | * | 1/1989 |
| WO | WO 94/20810 | * | 9/1994 |
| WO | WO 094020810 A1 | * | 9/1994 |

* cited by examiner

*Primary Examiner*—Michael J. Carone
*Assistant Examiner*—John Richardson
(74) *Attorney, Agent, or Firm*—Baker Botts L.L.P.

(57) ABSTRACT

A reactive armor structure having an outer layer and a reactive element adjacent to and integral with the outer layer is provided. The reactive element provides an amount of support to the outer layer effective to restrain movement of the outer layer and to delay fracture of the outer layer when the outer layer is impacted by a projectile.

24 Claims, 1 Drawing Sheet

REACTIVE STIFFENING ARMOR SYSTEM

GOVERNMENT CLAUSE

The United States Government has a paid-up license in this invention and the right in limited circumstances to require the patent owner to license others on reasonable terms as provided for by the terms of Contract Number DAAK60-97-C-9228 awarded by USA Material Command Acquistion Center.

FIELD OF THE INVENTION

The present invention relates to a reactive armor system having an outer layer that is supported and stiffened by a reactive element upon impact by a projectile.

BACKGROUND OF THE INVENTION

Several types of armor systems have been developed for protecting vehicles, structures and soldiers from the threat of armor piercing bullets. Lightweight armor systems that defeat armor piercing bullets typically use an outer layer such as ceramic and a metal or composite material as a substrate. The plates can be sewn into vests for body armor or attached to the outside of a structure or vehicle.

The performance of armor systems can be measured by their areal density defined as the weight per unit cross-sectional area necessary to defeat the threat. The lower the areal density, the less weight required to provide ballistic protection from the threat. Improvements in lightweight armor have resulted from improvements in ceramic technology and improved substrate performance resulting in metal, typically steel or aluminum, plates being replaced by fiber-reinforced composite panels that are lighter. However, larger decreases in areal density are needed to form lightweight armor that is practical for a soldier or a lightweight vehicle.

Conventional reactive armor comprises an explosive material positioned between plates. The plates and the explosive material react in response to the impact of a projectile. The impact causes detonation of the explosive material, generating enough force to move the plates. The interaction of the moving plates and the moving projectile act to defeat the projectile. In these systems, the outer plate typically is penetrated by the projectile but then acts on the projectile by virtue of being set in motion. The backing plate is also put in motion to act on the projectile. Current reactive systems are still very heavy and thus not practical for lightweight applications.

There is a need for a reactive armor system that is effective against armor piercing projectiles and lightweight enough to be worn by humans.

SUMMARY OF THE INVENTION

Figure 1:
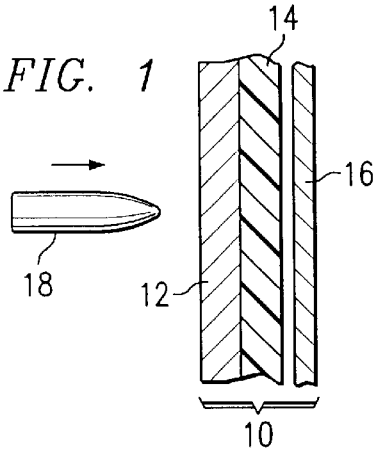
FIG. 1 is a schematic drawing of an armor structure in accordance with one embodiment of the present invention.

The present invention provides a reactive armor structure comprising an outer layer backed by a reactive element comprising a reactive material adapted to provide support to the outer layer and restrain movement of the outer layer upon impact by a projectile. Preferably, upon impact by a projectile, the reactive material has a detonation velocity effective to produce an amount of pressure that performs a function selected from the group consisting of delaying fracture of the outer layer and preventing fracture of the outer layer.

DETAILED DESCRIPTION OF THE INVENTION

The present invention provides a lightweight reactive armor structure that defeats armor piercing projectiles by providing dynamic stiffening properties to the back of an outer layer. The structure uses a reactive element comprising a reactive material that, upon detonation, provides an amount of support to a back surface of the outer layer effective to delay and/or prevent fracture of the outer layer. The phrase "reactive material" is defined herein to mean a material that is explosive or energetic and will react with itself under certain conditions. The term "fracture" is defined as through fracture where cracks in the outer layer run from the top surface through to the bottom surface of the outer layer.

The reactive material increases the stiffness of the outer layer in response to the force of impact from a projectile in an amount effective to delay fracture of the outer layer. As a result, the outer layer does not fracture or move upon detonation of the explosive layer. Rather the explosive material provides sufficient pressure against the back surface of the outer layer to counteract the loading by the projectile and to maintain the outer layer's integrity long enough to delay or preferably prevent fracture of the outer layer by the projectile. The armor structure is effective in defeating armor piercing bullets and is lightweight enough to be worn by humans.

The delay in fracture means that the outer layer fractures later in time than it would without the reactive element. Delaying fracture of the outer layer results in increasing the amount of time the projectile dwells on the outer layer, thus losing its kinetic energy, and allowing the outer layer to either completely defeat the projectile or cause considerable damage to the incoming projectile. If the projectile does penetrate the outer layer, it has been reduced in size through erosion and it does so at reduced velocity, making it easier for subsequent layers to stop the projectile. The efficiency of commercially available lightweight hard materials used in the outer layer is therefore increased by using a reactive element to stiffen the outer layer upon impact by a projectile. The performance of the armor structure will vary depending upon the materials used to make the armor structure and the type of projectile.

The preferred delay in fracture will vary depending upon the particular end use for the armor structure and the projectile encountered. Generally, the delay in fracture to defeat a given projectile can be from as little as 1 microsecond up to a time (t) where t equals the length of the projectile divided by the muzzle velocity. The muzzle velocity is the speed of the projectile as it exits the gun. For example, a delay in the fracture of the outer layer of only 3 microseconds imparts an increase in effectiveness, measured by a reduction in the kinetic energy of a 0.30 inch caliber armor piercing projectile at the outer layer, of about 10%. The delay in fracture can be anywhere from about 1 $\mu$s to about 50 $\mu$s or more for a 30 caliber armor piercing bullet depending upon the components used to make the armor structure. Likewise, larger projectiles used with larger armor structures will require a longer delay time.

The outer layer can be any hard, preferably inert material. The term "inert" as used herein means non-explosive material that does not react with itself or other materials. Suitable inert materials include but are not necessarily limited to ceramic, metal, ceramic/metal composites, and functionally graded materials, ceramic being preferred. Suitable ceramics include but are not necessarily limited to boron carbide, silicon carbide, alumina, aluminum nitride, tungsten carbide, titanium diboride and combinations thereof. The hardness and fracture toughness values of the inert material will vary depending upon the inert material Used. The delay in fracture will depend on the type of projectile and the armor structure used.

The reactive element has at least one layer of reactive material such as an explosive and/or energetic material that provides additional stiffness or support to the outer layer by supplying pressure and/or force to the back surface of the outer layer that is sufficient to counteract the amount of pressure and/or force exerted on the front surface of the outer layer by the incoming projectile. Prior art devices use explosive or energetic materials to move plates relative to the incoming projectile. In contrast, the armor structure of the present invention has an outer hard layer that remains stationary upon detonation of the explosive material in response to an incoming projectile. The outer layer of the present invention preferably is effectively stiffened by the reactive layer such that it is not penetrated or fractured by the projectile. However, in the situation where the projectile does manage to penetrate the outer layer, it does so with a reduced kinetic energy, size, and velocity that can be stopped by subsequent ballistic layers.

A variety of energetic and/or explosive materials may be used in the reactive element of the armor structure. Commonly used explosives may be modified for use in the present invention to produce the required amount of force to counteract the force of a given projectile. Alternatively, explosive materials may be used with complex burn geometries as described in more detail below. The reactive material is designed to stiffen the outer layer and the amount of explosive can be calculated accordingly. Preferred reactive materials will provide sufficient energy to counteract the force exerted on the outer layer by the projectile.

In choosing an energetic material suitable for use in the present invention, conventional high explosives have detonation velocities on the order of 6–9 km/s, which produce front speeds that lead to the energy and pressures being released too quickly to effectively provide stiffening properties. There are two approaches to achieve the slower release of reactive products to maintain the required backing pressures.

One approach to effectively reducing the detonation speed of an explosive is to introduce "complex burn geometries" defined as explosive and/or energetic materials in various geometric configurations that reduce the average burn speed of the explosive material and allow the release of reactive products from the explosive material in a more localized area over an extended time. The geometric configurations are bounded or defined by a non-reactive material or buffer that further directs the burn along a predetermined path. for example, an explosive material formed into a given spiral configuration will burn the same amount of explosive per unit time.

These complex burn geometries use standard high explosives with buffer material located along a defined path or edge. Suitable explosives include but are not necessarily limited to TNT, RDX, Comp-B, Octol, nitromethane. The buffer material prevents the explosive burn from deviating from the predefined path. Suitable buffer material include but are not necessarily limited to rubber, explosive binders, plastics, and phenolics. By directing the burn along a specific path, the quantity of explosive burned at any given point in time is reduced thereby reducing the pressure generated by the burn by a factor equivalent to a reduction in effective detonation velocity.

In order to have more balance in the loading, it is desirable to create half spirals of explosive material with similar properties that burn away from the impact point, and reflect these half spirals around a center line, thus leading to balanced release on either, side of the center line. Alternatively, wedge shaped burn designs reflected about a center point may also be used. The wedge shapes like the spirals would be bordered by a non-reactive buffer material. Such designs have the complications of being hit location sensitive. Thus, in practice, there would be many such predefined complex geometries of finite extent in the reactive layer.

In an alternative approach, an explosive can be produced that detonates more slowly, so that the explosive product gases produced generate higher pressures in the region of interest for longer periods of time. Suitable slow detonating explosives can be made by mixing propellants and explosives, chemically modifying explosives, and/or using blasting explosives such as ANFO. This approach has been demonstrated to work in large scale numerical simulations with explosives variants having slower burn or detonation rates.

Since the majority of burning and detonation data is for high explosives, having detonation velocities of 6–9 km/s, the approach to calculating the properties of lower energy energetic materials was to adjust the known properties of a high explosive, and use the adjusted properties to calculate the detonation velocity required to produce a certain amount of pressure. In large scale simulations, the explosive was modeled using the Jones-Wilkins-Lee (JWL) equation of state, which has eight fitting coefficients (as discussed in B. M. Dobratz and P. C. Crawford, *LLNL Explosives Handbook,* UCRL-52997, Lawrence Livermore National Laboratory, Livermore, Calif., 1985):

$$P = A\left(1 - \frac{\omega}{R_1 V}\right)e^{-R_1 V} + B\left(1 - \frac{\omega}{R_2 V}\right)e^{-R_2 V} + \frac{\omega E}{V}$$

$$P_s = Ae^{-R_1 V} + Be^{-R_2 V} + CV^{-(\omega+1)}$$

where A, B, and C are fit material constants with units of Mbar (millions of atmospheres), $R_1$, $R_2$ and $\omega$ are unitless fit constants, V is the specific volume of gaseous explosive products, E is the detonation energy per unit volume in Mbar, and P and $P_s$ are pressures in terms of Mbar. The eighth fitting parameter is the detonation velocity D.

The Chapman-Jouget (C-J) state is defined as the state of the explosive products directly behind the detonation front in the case of an explosive front advancing into the explosive as a flat plane at the detonation velocity; thus, the pressure and density of the explosive products directly behind the flat plane detonation front advancing at the detonation velocity are C-J pressure and C-J density, respectively. In determining how to adjust the JWL model coefficients that is consistent with mass, momentum, and energy conservation, the simple detonation model was used (Wildon Fickett and William C. Davis, *Detonation,* University of California Press, Berkeley, Calif., 1979). The simple detonation model leads to two expressions for the Chapman-Jouget (C-J) pressure:

$$P=\rho_0 D^2/(\gamma+1)$$

$$P=2(\gamma-1)\rho_0 E$$

where, P is C-J pressure, $p_o$ is the initial density of the solid explosive, D is the detonation velocity, E is the initial specific energy of the explosive, and $\gamma$ is ratio of the specific heats for the assumed ideal gaseous explosive products. Examination of this equation shows that to be consistent, if we introduce an explosive adjusting factor of $\lambda$, then:

$$D\rightarrow D/\lambda,\ P\rightarrow P/\lambda^2,\ E\rightarrow E/\lambda^2$$

For example, if the detonation velocity is decreased by a factor of $\lambda=2$, then the pressure will decrease by a factor of four, as will the energy. The C-J density would remain the same. Using this information, it is possible to adjust in a physically consistent manner the JWL equation of state using model coefficients for TNT as follows:

$$D=\frac{6.93}{\lambda}\ \text{km/s} \qquad P_{cj}=\frac{0.210}{\lambda^2}\ \text{Mbar}$$

$$A=\frac{3.712}{\lambda^2}\ \text{Mbar} \qquad B=\frac{0.03231}{\lambda^2}\ \text{Mbar} \qquad C=\frac{0.01045}{\lambda^2}\ \text{Mbar}$$

$$R_1,\ R_2,\ \omega \text{ are the same}$$

Thus, for a given $\lambda$, it is then possible to determine a consistent equation of state for an explosive having lower energy. Large scale numerical simulations showed that adjusted explosives with $\lambda$ between 2 and 2.5 were capable of producing enough pressure over a period of time effective to provide sufficient support to the outer layer to keep the outer layer stiff and delay the onset of fracture by the projectile. The-amount of pressure needed to delay or prevent fracture of the outer layer will vary depending upon the projectile.

The reactive material may either detonate upon impact of a projectile or be detonated by a secondary device triggered by the impact of the projectile, such as standard detonators. Alternatively, the reactive material can be triggered by an electronic projectile detection system and then a related electrical detonation system will detonate the reactive material. Pressure sensitive energetic materials may also be used.

The reactive element of the structure can have a variety of configurations incorporating one or more additional layers of material. For example, the reactive material may be sandwiched between two layers of an inert material. An inert layer may be positioned between the reactive material and the outer layer, or the reactive material may be followed by a layer of inert material. Suitable inert materials include but are not necessarily limited to metals, ceramics, and metal/ceramic composites, structural aerospace composites, and fabrics treated with resins to provide structural stiffness.

In addition to the reactive element and the outer layer, a resilient layer may be positioned behind the reactive element. There are a number of resilient materials available, any of which would be suitable for use with the present armor structure. Suitable resilient materials include but are not necessarily limited to ballistic fabrics, such as, nylon, Kevlar®, available from E. I. du Pont de Nemours and Company, Wilmington, Del., and poly(p-phenylene-2,6-benzobisoxazole) available from Toyobo Co. Ltd., Japan.

FIG. 1 is a sectional view of an armor structure 10 of the present invention. The armor structure 10 has an outer layer 12, a reactive layer 14, and a resilient layer 16. A projectile 18 is shown traveling toward the armor structure 10. Alternatively, the reactive layer may be sandwiched between two inert layers as described above. The ultimate configuration of inert layers and the resilient layer will vary depending upon the application.

Figure 2:
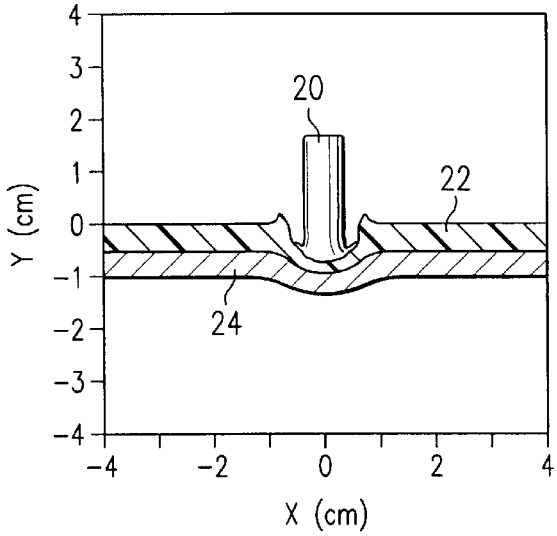
FIG. 2 is a large scale numerical simulation of a projectile impacting an armor structure shown in FIG. 1 without the reactive material.

FIG. 2 shows a large scale numerical simulation of a projectile 20 striking a conventional ballistic structure having a $B_4C$ outer layer 22 backed by a layer of aluminum 24. The projectile 20 is traveling at 850 m/s and after 20 $\mu$s has begun to penetrate the outer layer 22 of $B_4C$.

Figure 3:
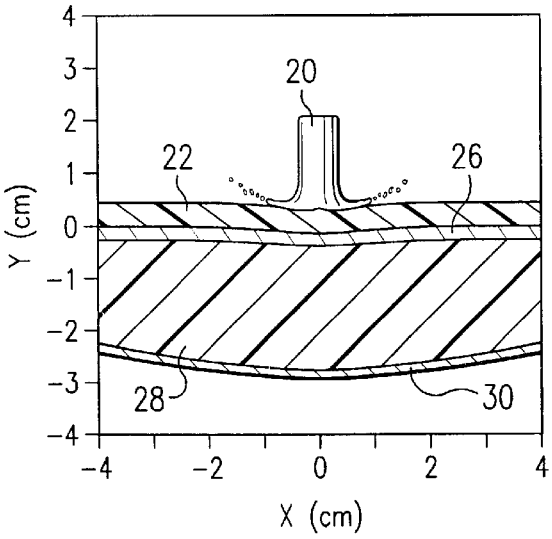
FIG. 3 is a large scale numerical simulation of a projectile impacting the armor structure of FIG. 1.

FIG. 3 shows a large scale numerical simulation of the same projectile 20 in FIG. 2 striking an armor structure in accordance with one embodiment of the present invention having a $B_4C$ outer layer 22 followed by a metal/ceramic composite layer 26, a reactive layer 28, and a metal/ceramic composite layer 30. The projectile 20 is traveling at 850 m/s and after 20 $\mu$s has not fractured the outer hard layer 22 and is beginning to break up on the surface of the outer layer 22. In this simulation, the reactive layer successfully provided sufficient stiffness to the outer layer 22 to prevent fracture of the outer layer 22 for over 30 $\mu$s.

Figure 4:
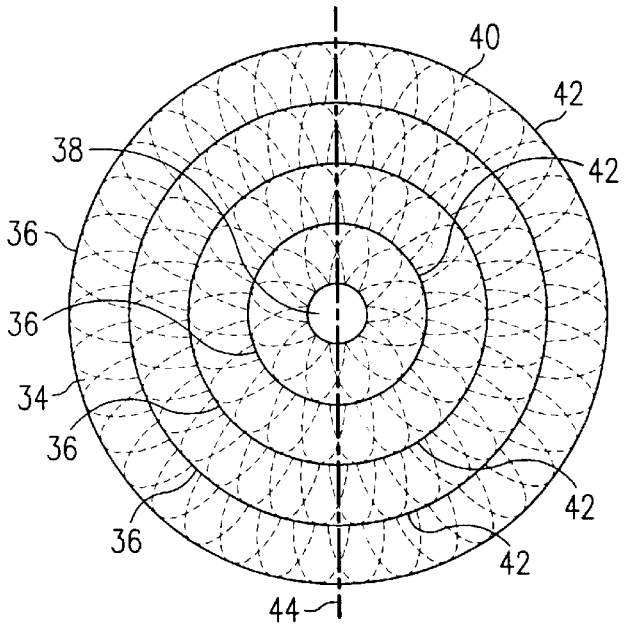
FIG. 4 is a schematic representation of a complex burn geometry for the reactive material of the armor structure.

FIG. 4 is a schematic representation of a complex burn geometry for the reactive material of the armor structure. The explosive or energetic material 34 follows a "half spiral" path defined by a buffer material 36. The explosive if ignited in or near the center 38, would burn along the path in an outward direction. In operation, a second "half spiral" would be positioned as a mirror image of the first "half spiral" in order to balance the loading. The second half spiral, like the first contains an explosive material 40 following a path defined by a buffer material 42. The centerline indicated by line 44 is drawn for clarification purposes only and is not a part of either half spiral structure. However, it is possible, but not necessary, to place a buffer material along the centerline between the two half spirals. The explosive material 34 and 40, when ignited will tend to burn along their respective paths at substantially the same rate thus producing a substantially uniform pressure against the back surface of the outer layer. As noted previously, this type of burn geometry is impact point sensitive, therefore multiple burn geometries would be used in the reactive layer of the armor structure.

The armor structure of the present invention can be scaled up or down as needed to protect structures such as buildings, vehicles, and humans. Regardless of the end use, the armor structure is preferably made in sections that are insulated from one another such that activation of one section will not cause activation of adjacent sections. Methods for achieving this goal are well known to those of ordinary skill in the art. For example, the armor structure could be sewn into a vest for use on a soldier or law enforcement officer, such that the individual armor structures are physically separated from one another. Means for attaching the armor structure to a vehicle or building are also well known.

Persons of ordinary skill in the art will recognize that many modifications may be made to the present invention without departing from the spirit and scope of the present invention. The embodiment described herein is meant to be illustrative only and should not be taken as limiting the invention, which is defined in the following claims.

We claim:

1. An armor structure comprising:

at least one protective outer layer;

a reactive layer backing the outer layer, the reactive layer comprising a reactive material;

having a predetermined detonation velocity calculated to maintain pressure in the region of the outer layer for a period of time sufficient to provide support to the outer layer, such that the onset of fracture of the outer layer by the projectile is delayed in comparison to an armor structure without the reactive layer.

2. The structure of claim 1 wherein said fracture is delayed for about 1 $\mu$s or more.

3. The structure of claim 1 wherein said fracture is delayed for about 20 $\mu$s or more.

4. The structure of claim 1 wherein said fracture is delayed for about 40 $\mu$s or more.

5. The structure claim 1 wherein said fracture is delayed for about 1 microsecond up to a time (t) where $$t = \frac{\text{length of said projectile}}{\text{the muzzle velocity of said projectile}}.$$

6. The structure of claim 1 wherein said outer layer comprises a material selected from the group consisting of ceramic, metal, functionally graded materials, and combinations thereof.

7. The structure of claim 1 wherein said reactive material is selected from the group consisting of an energetic material, an explosive material, and mixtures thereof.

8. The structure of claim 1 further comprising at least one inert layer between the reactive layer and the outer layer.

9. The structure of claim 1 further comprising a resilient layer adjacent to said reactive such that the reactive layer is sandwiched between the outer layer and the resilient layer.

10. The structure of claim 1, wherein the explosive material has a detonation velocity of from about 2 km/s to about 5 km/s.

11. The structure of claim 1 wherein said outer layer remains stationary in response to the incoming projectile.

12. The armor structure of claim 1 further comprising a second inert layer behind said reactive layer.

13. An armor structure comprising:

at least one protective outer layer having a front surface and a back surface, a reactive layer adjacent to said back surface of said outer layer, said reactive layer adapted to increase the stiffness of said outer layer in response to impact of a projectile in an amount effective to delay fracture of said outer layer, wherein said fracture is delayed for about 1 microsecond up to a time (t) where $$t = \frac{\text{length of said projectile}}{\text{the muzzle velocity of said projectile}}.$$

14. The armor structure of claim 13, wherein said reactive layer has a detonation velocity of from about 2 km/s to about 5 km/s.

15. An armor structure comprising:

at least one protective outer layer;

a reactive layer backing the outer layer, the reactive layer comprising a reactive material having a complex burn path effective to increase the overall detonation time of said reactive material, such that fracture of the outer layer is delayed in comparison to an armor structure without the reactive layer.

16. The structure of claim 15 wherein said reactive material forms a path defined by a non-reactive material.

17. The structure of claim 15 wherein said outer layer comprises a material selected from the group consisting of ceramic, metal, functionally graded materials and combinations thereof.

18. The structure of claim 15 wherein said reactive layer comprises a material selected from the group consisting of an energetic material, an explosive material, and mixtures thereof.

19. The structure of claim 15 wherein said reactive element further comprises at least one inert layer.

20. The structure of claim 15 wherein said outer layer remains stationary in response to the incoming projectile.

21. The armor structure of claim 19 wherein said inert layer is between said reactive layer and said outer layer.

22. The structure of claim 15, wherein the complex burn path has a spiral pattern.

23. The structure of claim 15, wherein the complex burn path has a wedge pattern.

24. The structure of claim 15 wherein said reactive material comprises a material selected from the group consisting of TNT, RDX, Comp-B, Octol, and nitromethane.

* * * * *